United States Patent [19]

Kondo et al.

[11] Patent Number: 4,824,454

[45] Date of Patent: Apr. 25, 1989

[54] DEVICE FOR LIQUEFYING A GAS

[75] Inventors: Hitoshi Kondo, Nagoya; Koichi Hata, Toyota, both of Japan

[73] Assignee: Aisin Seiki Kabushiki Kaisha, Kariya, Japan

[21] Appl. No.: 164,408

[22] Filed: Mar. 4, 1988

[30] Foreign Application Priority Data

Mar. 5, 1987 [JP] Japan ..... 62-051151

[51] Int. Cl.[4] ..... F25J 3/00

[52] U.S. Cl. ..... 62/37; 62/54; 62/119

[58] Field of Search ..... 62/54, 119, 36, 37

[56] References Cited

U.S. PATENT DOCUMENTS

| | | | |
|---|---|---|---|
| 3,561,229 | 2/1971 | Levin | 62/119 |
| 3,848,424 | 11/1974 | Rhea | 62/119 |
| 4,543,794 | 10/1985 | Matsutani et al. | 62/54 |

*Primary Examiner*—Ronald C. Capossela

*Attorney, Agent, or Firm*—Oblon, Fisher, Spivak, McClelland & Maier

[57] ABSTRACT

In order to prevent icing of the cryogen, a device for liquefying a gas includes a heater provided in a cooling chamber at the output of a Sterling cycle engine. The heater is controlled by a gas pressure sensor in the cryostat in communication with the chamber and matches the cooling load to the cooling capacity of the Sterling cycle engine.

5 Claims, 2 Drawing Sheets

DEVICE FOR LIQUEFYING A GAS

BACKGROUND OF THE INVENTION

1. Field of the Invention

The present invention relates to a device for liquefying a gas.

2. Prior art of the present invention

A conventional device for liquefying a gas, as shown in FIG. 1, includes a vessel 17 in which an amount of liquid cryogen 18 such as Neon, Argon or Nitrogen is contained. In the liquid cryogen 18, there is immersed an object (not shown) to be cooled. Due to heat generation from the object, liquid cryogen 18 is evaporated and the resulting gas cryogen enters into a chamber 13 via a conduit 15 as shown in dotted-line in FIG. 1. Since an interior portion in the chamber 13 is cooled at or below a temparature by a refrigerator 10 which is driven by a motor 27, as cryogen is condensed back to a liquid and resulting liquid cryogen returns into the vessel 17 via the conduit 15 as shown in solid-line in FIG. 1.

However, the conventional device for liquefying a gas has the following drawbacks. That is to say, since gas cryogen and liquid cryogen flow in opposite directions in common conduit 15, both gas and liquid cryogen are mixed, to some extent, with each other, resulting in that smooth movements thereof are prevented. Furthermore, in the case that capacity for liquefying a gas in the chamber 13 is greater than heat quantity radiated from the object, cryogen to be returned to the vessel 17 as a liquid is frozen into ice.

SUMMARY OF THE INVENTION

It is, therefore, a principal object of the present invention to provide a device for liquefying a gas without the aforementioned drawbacks.

It is another object of the present invention to provide a device for liquefying a gas comprising, (a) a vessel containing therein an amount of liquid cryogen and having a space above the surface of said liquid cryogen; (b) a chamber; (c) a first conduit for connecting an upper side of an interior portion in said chamber and said space in said vessel; (d) a second conduit for connecting a lower side of said interior portion in said chamber and an inside portion of said liquid cryogen; (e) a sensor for detecting the pressure in said vessel; (f) cooling means provided in said chamber for liquefying a gas; (g) heater means provided around said cooling means in said chamber; and (h) a control device for controlling the quantity of the electric charge to said heater means according to signal from said sensor.

According to the present invention, gas cryogen, as a result of evaporation of the liquid cryogen due to heat-radiation from the object immersed therein, enters into the chamber via the first conduit and is condensed back to liquid cryogen by cooling in the chamber. Resulting liquid cryogen is, then, returned into the vessel via the second conduit. Since no counter-flows exist between the chamber and the vessel, liquid cryogen may be returned smoothly into the vessel. Furthermore, since the quantity of cryogen to be liquefied may be equalized to the quantity of evaporated cryogen by the actuation of the control device, liquefied cryogen may not be frozen into ice.

DESCRIPTION OF THE PREFERRED EMBODIMENT

Figure 1:
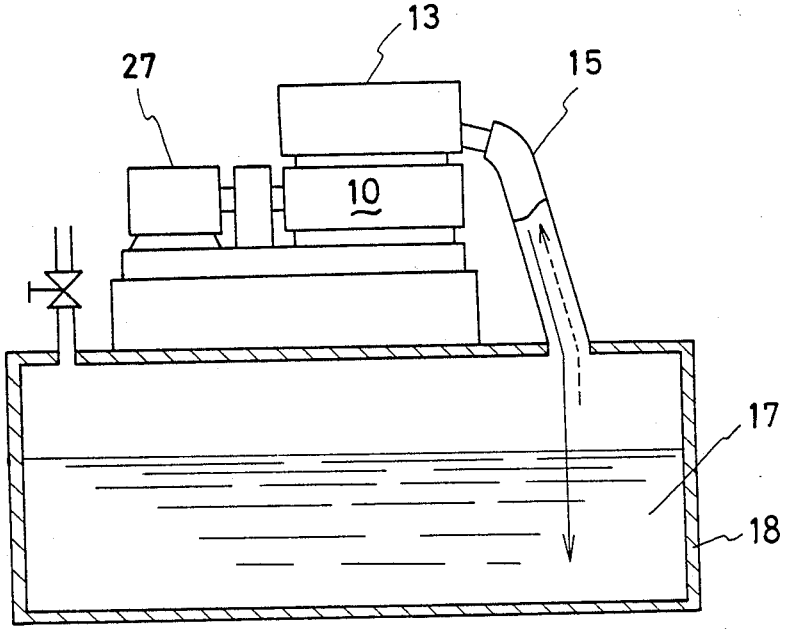
Fig. 1 (PRIOR ART)
FIG. 1 is a cross-sectional view of a conventional device for liquefying a gas.
Figure 2:
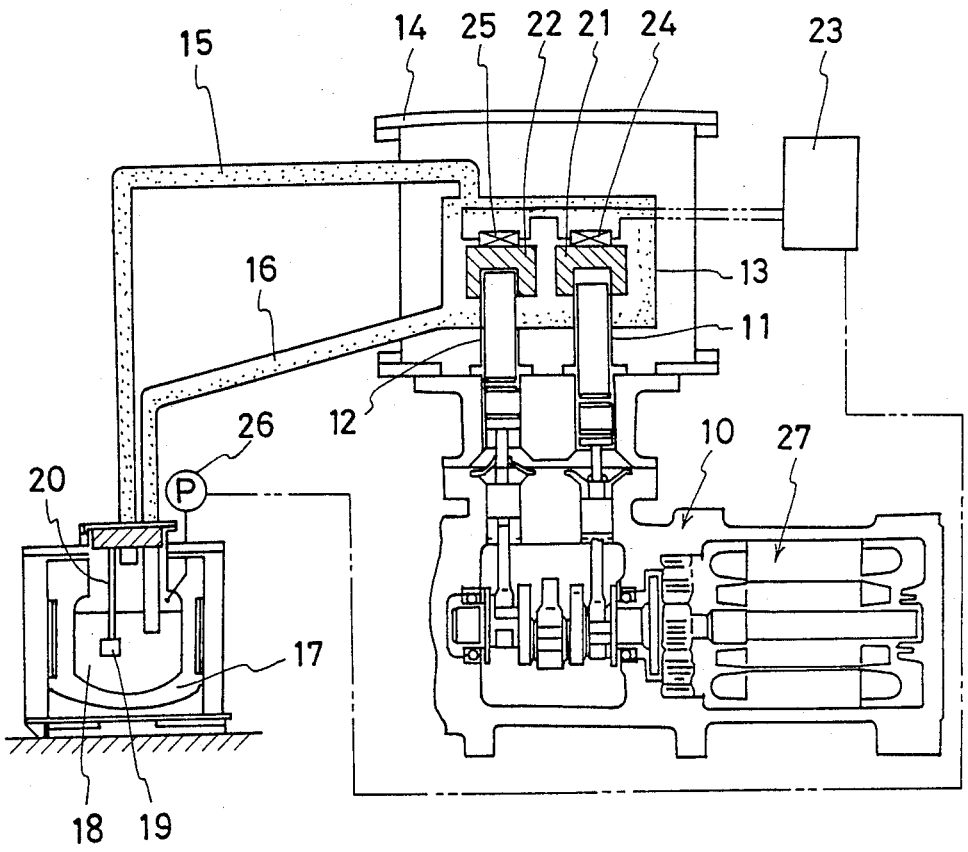
FIG. 2 is a cross-sectional view of a device for liquefying a gas according to the present invention.

Referring now to FIG. 1, a Stirling cycle refrigerator 10 includes a pair of expansion cylinders 11 and 12. As well-known, when the Stirling cycle refrigerator 10 is brought into operation by a motor 27, top end portions of the cylinders 11 and 12 are cooled into a frozen condition. The cylinders 11 and 12 are extended into a chamber 13. The chamber 13 is covered with a vacuum case 14 so as to be heat-insulated from the atmosphere.

The chamber 13 is connected to an interior portion of a vessel or cryostat 17 by a first heat-insulated conduit 15 and a second heat-insulated conduit 16. In the interior portion of vessel or cryostat 17, there is contained an amount of liquid cryogen 18. In the liquid cryogen 18, an object 19 such as a semi-conductor element or a vivo is immersed to be cooled. Above the surface of the liquid cryogen 18, there is defined a space 20. A lower opening of the first conduit 15 is exposed into the space 20 and is in opposition to the surface of the liquid cryogen 18 at a distance. An upper opening of the first conduit 15 is exposed into an upper side of the interior portion of the chamber 13. Thus, gas cryogen as a result of evaporation of the liquid cryogen 18 due to heat-generation from the object enters into the interior portion in the chamber 13.

In the chamber 13, a pair of heat exchangers 21 and 22 are mounted to the cylinders 11 and 12, respectively. Gas cryogen is cooled by the cylinders 11 and 12 via the heat exchangers 21 and 22 so that gas cryogen is condensed back to liquid cryogen. Resulting liquid cryogen is, then, retuned into the cryostat 17 via the second conduit 16. An upper opening and lower opening of the second conduit 16 are, respectively, positioned at a lower side of the interior portion in the chamber 13 and in the liquid cryogen 18 in the cryostat 17.

In the cryostat 17, there is installed a pressure sensor 26 from which a signal corresponding to the pressure in the cryostat 17 is continually transmitted to a control device 23 in the form of micro-processor. In the control device 23, a signal from the sensor 26 is compared with a reference or a set value. In accordance with difference as a result of the afore-mentioned comparison, the control device 23 adjusts the quantity of electric power to a pair of heaters 24 and 25 mounted on the heat exchangers 21 and 22, respectively. Due to the variation in electric power to the heaters 24 and 25, heat-exchange ratio therein is varied with the result that capacity for liquefying a gas may be controlled.

Assuming that the object 19 with high heat content is replaced with one with low heat content, the amount of evaporation of the liquid cryogen 18 is decreased thereby increasing pressure in the cryostat 17. According to the decrease in pressure in the cryostat 17, the control device 23 increases the electric power to the heaters 24 and 25. Thus, capacity for liquefying a gas in the chamber 13 is dropped and resulting capacity is reduced only to liquefy the gas entered into the chamber 13. There is no fear that surplus capacity for liquefying a gas freezes liquid cryogen in the returning movement to the cryostat 17.

What is claimed is:

1. A device for liquefying a gas, comprising:

(a) a vessel containing therein an amount of liquid cryogen and having a space above the surface of said liquid cryogen;

(b) a chamber;

(c) a first conduit for connecting an upper side of an interior portion in said chamber and said space in said vessel;

(d) a second conduit for connecting a lower side of said interior portion in said chamber and said liquid cryogen in said vessel;

(e) a sensor for detecting the pressure in said vessel;

(f) cooling means provided in said chamber for liquefying a gas;

(g) heater means provided around said cooling means in said chamber for producing heat as a function of a quantity of electrical power provided thereto; and (h) a control device for controlling the quantity of the electric power to said heater means according to a signal from said sensor.

2. A device for liquefying a gas in accordance with claim 1 wherein said cooling means includes a refrigerator having an expansion cylinder which is extended into said chamber and a heat-exchanger mounted to said expansion cylinder.

3. A device for liquefying a gas in accordance with claim 2 wherein said refrigerator is a Stirling cycle refrigerator.

4. A device for liquefying a gas in accordance with claim 1 wherein said chamber is heat-insulated.

5. A device for liquefying a gas in accordance with claim 1 wherein said first and second conduits are heat-insulated.

* * * * *